US006752622B2

(12) United States Patent
Lesesne

(10) Patent No.: US 6,752,622 B2
(45) Date of Patent: Jun. 22, 2004

(54) LAMP AND CANDLE WITH A COLORED FLAME

(76) Inventor: John Sherman Lesesne, 402 Thornton La., Georgetown, TX (US) 78628

( * ) Notice: Subject to any disclaimer, the term of this patent is extended or adjusted under 35 U.S.C. 154(b) by 0 days.

(21) Appl. No.: 09/876,166

(22) Filed: Jun. 6, 2001

(65) Prior Publication Data

US 2002/0187445 A1 Dec. 12, 2002

(51) Int. Cl.[7] ..... C10L 10/10

(52) U.S. Cl. ..... 431/126; 431/288; 431/319; 431/320; 431/321; 44/642

(58) Field of Search ..... 431/288, 125, 431/126, 4, 321, 319; 44/275, 642, 452; 208/420, 421, 422, 423, 427, 435; 362/159

(56) References Cited

U.S. PATENT DOCUMENTS

| | | | | | |
|---|---|---|---|---|---|
| 17,658 | A | * | 6/1857 | Adams | 431/319 |
| 35,264 | A | * | 5/1862 | Seybold | 431/321 |
| 38,149 | A | * | 4/1863 | Colburn | 431/321 |
| 126,075 | A | * | 4/1872 | Mott | 431/319 |
| 237,668 | A | * | 2/1881 | Aikman et al. | 431/316 |
| 1,036,514 | A | * | 8/1912 | Nichols | 431/321 |
| 1,583,798 | A | * | 5/1926 | Rosenberg | 431/125 |
| 1,908,044 | A | * | 5/1933 | Nelson et al. | |
| 2,184,666 | A | * | 12/1939 | Fredericks | |
| 2,189,871 | A | * | 2/1940 | Thomas | 62/298 |
| 2,270,442 | A | * | 1/1942 | Jares | 431/4 |
| 2,551,574 | A | * | 5/1951 | Fredericks | |
| 3,107,511 | A | * | 10/1963 | Hamsag-Garshania et al. | |
| 3,424,540 | A | * | 1/1969 | Swedenberg | |
| 3,630,697 | A | * | 12/1971 | Duling | |
| 3,726,731 | A | * | 4/1973 | Kliott | 149/108.4 |
| 3,790,332 | A | * | 2/1974 | Woollard | 431/126 |
| 3,811,817 | A | * | 5/1974 | Mansnerus et al. | 431/126 |
| 3,871,815 | A | * | 3/1975 | Cangardel | |
| 4,014,637 | A | * | 3/1977 | Schena | 431/4 |
| 4,309,189 | A | | 1/1982 | Oberhardt | |

(List continued on next page.)

FOREIGN PATENT DOCUMENTS

| | | | | |
|---|---|---|---|---|
| CA | 2245391 | * | 2/2000 | 431/126 |
| CH | 449555 | | 1/1968 | |
| CH | 449555 | * | 7/1968 | 431/126 |
| DE | 2222939 | * | 11/1972 | 431/126 |
| DE | 19961548 | * | 6/2001 | 431/126 |
| EP | 1111300 | * | 6/2001 | 431/126 |
| FR | 002694374 | * | 2/1994 | 431/126 |
| FR | 002695401 | * | 3/1994 | 431/126 |
| JP | 62-72794 | * | 3/1987 | |
| JP | 63258987 | * | 10/1988 | 431/126 |
| JP | 02-120395 | * | 5/1990 | 431/126 |
| JP | 04063892 | * | 2/1992 | 431/126 |
| JP | 04-154899 | * | 5/1992 | 431/126 |
| JP | 2000-74599 | * | 3/2000 | 431/126 |
| WO | WO 009800480 | * | 1/1998 | 431/126 |
| WO | WO 98/11176 | * | 3/1998 | 431/126 |

OTHER PUBLICATIONS

"Duraflame: Products—Firelogs"; Copyright 2001 Duraflame, Inc.; 2 pages.

"Big Ben Imports"; Copyright 2000 Big Ben Imports; 3 pages.

*Primary Examiner*—Carl D. Price
(74) *Attorney, Agent, or Firm*—Meyertons, Hood, Kivlin, Kowert & Goetzel, P.C.; Eric B. Meyertons

(57) ABSTRACT

The present invention provides various embodiments for a colored flame lamp and a colored flame candle. The lamps and candles may burn with a flame of a characteristic color such as green, red, blue, purple, orange, or silver-white. The lamp fuel composition may include a liquid solvent and dissolved metal salts. The candles may be composed of a solvent, a hardener, and metal salts dissolved in the solvent. The colored flame in the lamp and candle results from vaporized metal salts that travel up a wick with lamp fuel or melted candle material.

49 Claims, 2 Drawing Sheets

U.S. PATENT DOCUMENTS 4,365,971 A * 12/1982 Monick ..... 44/266
4,386,904 A * 6/1983 Miyahara
4,475,483 A * 10/1984 Robinson ..... 123/1 A
4,536,188 A * 8/1985 de Witt et al. ..... 44/318
4,575,379 A * 3/1986 Browning ..... 44/267
4,604,053 A * 8/1986 de la Rosa ..... 431/320
4,624,633 A * 11/1986 Bandel ..... 431/320
4,689,727 A * 8/1987 Perkins ..... 362/161
4,705,532 A * 11/1987 Mazanec et al. ..... 44/452
4,725,225 A * 2/1988 Gravitt ..... 431/320
4,858,826 A 8/1989 Robinson et al.
4,895,511 A * 1/1990 Schmid ..... 431/126
4,932,979 A 6/1990 Thrasher et al.
4,997,457 A 3/1991 Mitsusawa et al.
5,127,922 A * 7/1992 Bension
5,266,080 A * 11/1993 Kiovsky et al. ..... 44/312
5,326,379 A * 7/1994 Gardner ..... 44/540
5,716,204 A 2/1998 Mifune et al.
5,743,724 A 4/1998 Mifune et al.
5,858,031 A 1/1999 Perlman
5,858,036 A 1/1999 Chandaria
5,958,090 A 9/1999 Chandaria
6,035,847 A * 3/2000 Paul ..... 126/43
6,120,566 A 9/2000 Mifune et al.
6,165,234 A 12/2000 Kanakkanatt
6,193,769 B1 * 2/2001 Dakin et al. ..... 44/519
6,203,313 B1 3/2001 Holmes et al.
6,488,726 B1 * 12/2002 Lim et al. ..... 44/451

* cited by examiner

LAMP AND CANDLE WITH A COLORED FLAME

BACKGROUND OF THE INVENTION

1. Field of the Invention

The present invention generally relates to lamps and candles that burn with a characteristic color. More particularly, the present invention relates to lamps and candles that burn with a colored flame.

2. Description of the Related Art

A conventional oil lamp generally includes a vessel containing oil with a wick soaked in the oil. The wick is ignited to produce illumination from a flame that is a conventional yellow color. The precise origin of the oil lamp is obscure, but such lamps were in general use in Greece by the 4th century B.C. and centuries earlier in Egypt. The first oil lamps were open vessels made of stone, clay, bone, or shell in which fat or oil was burned. Later lamps were partially enclosed reservoirs, containing fat or oil that were provided with a small hole into which a wick of flax or cotton was set. The fuel is drawn up the wick by capillary action and burned at the end of the wick.

A colored flame candle is described in U.S. Pat. No. 4,386,904 to Miyahara et al. In order to produce vividly colored flames, instead of conventional primary combustion agents, such as paraffin and stearic acid, which produce a yellowish orange color by themselves, the primary combustion materials are used which form a colorless flame such as ethyl carbamate (urethane), dimethyl oxalate, and/or trioxane. In addition, an oxidation accelerator catalyst is absorbed on the cotton combustion wick, to result in a candle that itself burns with a strictly colorless flame. A coloring wick is separately fabricated containing a color-forming compound as well as oxidation accelerating catalyst and preferably may be coated with resin on its surface. The coloring wick is then placed adjacent the combustion wick, and a candle is formed using the aforementioned primary combustion material. One or several coloring wicks may be embedded parallel to the combustion wick or may be embedded coiled around the combustion wick.

U.S. Pat. No. 5,127,922 to Bension describes a candle that burns with a colored flame, which is free of the yellow color, usually found in the conventional paraffin candle. The candle comprises a shell made of a saturated thermoplastic material and 10–30% of a fire retardant. The fuel consists of 70–100% of a polyoxymethylene, 0–30% of a binder, and 0–20% of a solvent. The candle also comprises 1–10% of a flame-coloring agent, such as a salt or an oxide of Li, B, Na, Ca, Cu, K, Sr, In, or Ba. The candle does not require a wick.

SUMMARY OF THE INVENTION

Described herein are lamps and candles that produce colored flames of a characteristic color. A colored flame is a flame with a color different from the flame of a fuel composition burning in the absence of a color producing compound or from the color of the flame of conventional lamps or candles which is yellowish in color.

In one embodiment, a system is described that includes a lamp that uses a fuel composition that may include a liquid solvent and one or more types of metal salts. At least a portion of the metal salts may be dissolved in the solvent. The solvent and metal salts migrate through a wick that is in contact with the fuel composition during use. The fuel composition absorbed by the wick may burn with a flame of a characteristic color that differs from the color the wick would burn in the absence of metal salts.

In one embodiment, the lamp includes a receptacle for the fuel composition. A wick is placed in contact with the fuel composition in the receptacle. The wick may be composed of a natural material such as cotton or a synthetic material such as fiberglass.

In one embodiment, the solvent may include a glycol, such as propylene glycol. The solvent may also include a small amount of a simple alcohol such as methanol, ethanol, or isopropanol. The solvent may also include a small amount of a hydrochloric acid solution. A variety of metal salts may be dissolved in the solvent which when vaporized produce a flame of a characteristic color. Exemplary metal salts include, but are not limited to, boric acid, lithium hydroxide, lithium chloride, strontium nitrate, copper hydroxide, copper chloride, copper sulfate, potassium hydroxide, sodium hydroxide, and magnesium hydroxide.

In one embodiment, a colored flame candle is composed of a solvent with one or more types of metal salts dissolved in the solvent and a hardener. A wick is immersed within the candle. The candle composition is melted by the flame. The melted composition, including the metal salts, migrate up the wick and then are vaporized. The metal salts in the candle composition cause the flame to burn with a characteristic color that is different from a color the flame would burn in the absence of the metal salts.

In one embodiment, the solvent may be a glycol (e.g., propylene glycol) and the hardener may be a long chain fatty acid (e.g., stearic acid). The candle composition may possess properties similar to conventional candle wax that make it suitable as fuel for a candle. Examples of metal salts include, but are not limited to, boric acid, lithium hydroxide, lithium chloride, strontium nitrate, copper hydroxide, copper chloride, copper sulfate, potassium hydroxide, sodium hydroxide, and magnesium hydroxide. The glycol and fatty acid may be combined in relative proportions that result in a candle that ranges from soft to hard. A conventional wick may be used.

Figure 1:
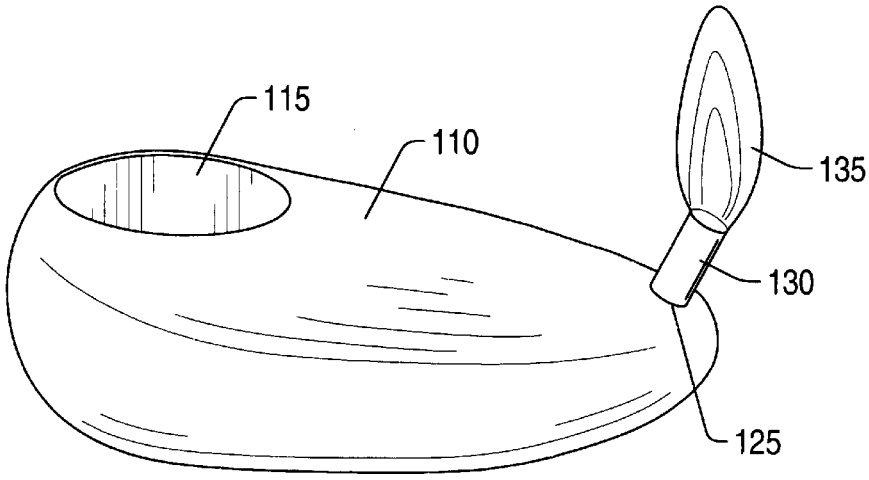
FIG. 1 is an illustration of a colored flame lamp with a Roman clay lamp receptacle design according to one embodiment.

While the invention is susceptible to various modifications and alternative forms, specific embodiments thereof are shown by way of example in the drawings and will be described in detail herein. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF SEVERAL EMBODIMENTS

Lamps and candles that burn with flames of a characteristic color such as red, green, blue, purple, orange or silver-white are desirable commercially for decorative and ceremonial purposes. Metal salts may be used to produce colored flames. When metal salts vaporize, they emit energy corresponding to a particular wavelength of light.

Embodiments of colored flame lamps and candles with bright, continuous flames of a characteristic color that are similar to conventional lamps and candles in their design, functionality, expense, ease of production, and lack of toxicity are described herein. In an embodiment, lamps and candles may use a fuel that will both dissolve metallic salts and possess the advantageous properties of oils and waxes.

As used herein, a colored flame is a flame with a color different from the flame of a fuel composition burning in the absence of the metal salts or from the color of the flame of conventional lamps or candles, which is yellowish in color.

In one embodiment, a lamp that burns with a colored flame may include a fuel composition within a receptacle. A wick may be in contact with the fuel composition at one end. The other end of the wick may extend to the outside of the receptacle. The fuel composition may include a liquid solvent and one more types of metal salts. At least a portion of the salts may be dissolved in the solvent. The solvent and the metal salts migrate through the wick. Igniting the end of the wick outside the receptacle may cause the wick to burn with a colored flame.

In one embodiment, fuel composition and metal salts may migrate through the wick and may be deposited on the wick surface. The fuel composition and metal salts may be heated and vaporized to produce a colored flame. The metal salt vapors may be carried up with a heated air column. The metal salts may take on heat energy as they rise. The metal salts may then release that energy as light at specific wavelengths that correspond to colored light.

In one embodiment, the wick exits through an opening in the receptacle. The opening may be on the side or a top of the receptacle. The receptacle may include a support tube located at the opening. The support tube may be composed of a material that can withstand the heat of a flame. For example, the support tube may be metallic, ceramic, or plastic. The wick may pass through the support tube to the exterior of the receptacle. The support tube may support the portion of the wick that extends beyond the receptacle. A portion of the wick may extend beyond the support tube. In one embodiment, the wick may extend from about 0.1 inch to about 0.5 inch beyond the support tube. In another embodiment, the wick may extend from about 0.5 inch to about 0.75 inch beyond the support tube. In one embodiment, the support tube may enhance the ability of the lamp to produce a colored flame by causing the fuel composition to vaporize with the metal salts at the base of the flame.

It may be advantageous to limit the vertical distance that metal ions migrate. Therefore, it may be an advantage to minimize the height of the wick above the surface of the fuel composition. In one embodiment, the height of the tip of the wick may be between about 0.5 inch to about 1.5 inches. In another embodiment, the height may be about 1.50 inches to about 1.75 inches. In one embodiment, the length of the wick may be about 1 inch to about 1.50 inches.

In one embodiment, the wick may be held at angle that is between vertical and a tangent to the fuel surface. Holding the wick at such an angle may decrease the vertical distance that the heavy metal ions may migrate. A support tube may hold the wick at the desired angle. In one embodiment, it may be advantageous to hold the wick at about 60 degrees or less above a tangent to the fuel composition surface. In another embodiment, the wick may be held at about 45 degrees or less above a tangent to the fuel composition surface.

In one embodiment, the wick may be composed of a flammable material. It may be advantageous to use a wick with a relatively high porosity. Metal ions of the metal salt have a molecular weight that may be greater than the molecular weight of the solvent. Migration of the metal ions may be facilitated by using a wick with a relatively high porosity. In addition, the wick may be composed of wound fibers. A wick composed of relatively loosely wound fibers may have significantly higher porosity than a wick that is relatively tightly wound. A relatively tightly wound wick may cause the fuel composition to be delivered in a less efficient manner resulting in a dry wick.

In one embodiment, the wick may be composed of a natural material such as cotton. Alternatively, the flammable material may be a synthetic material such as fiberglass. For example, Pepperill's fiberglass wick number 1284 may be used.

FIG. 1 is an illustration of a colored flame lamp with a Roman clay lamp receptacle design according to one embodiment. The lamp includes a receptacle 110 for holding the fuel composition. The fuel composition may be poured into the receptacle through opening 115. Wick 130 extends from the inside of the receptacle through opening 125. Colored flame 135 burns from the tip of wick 130. The wick may be at about a 45 degree angle or less above a tangent to the surface of the fuel composition.

Figure 2:
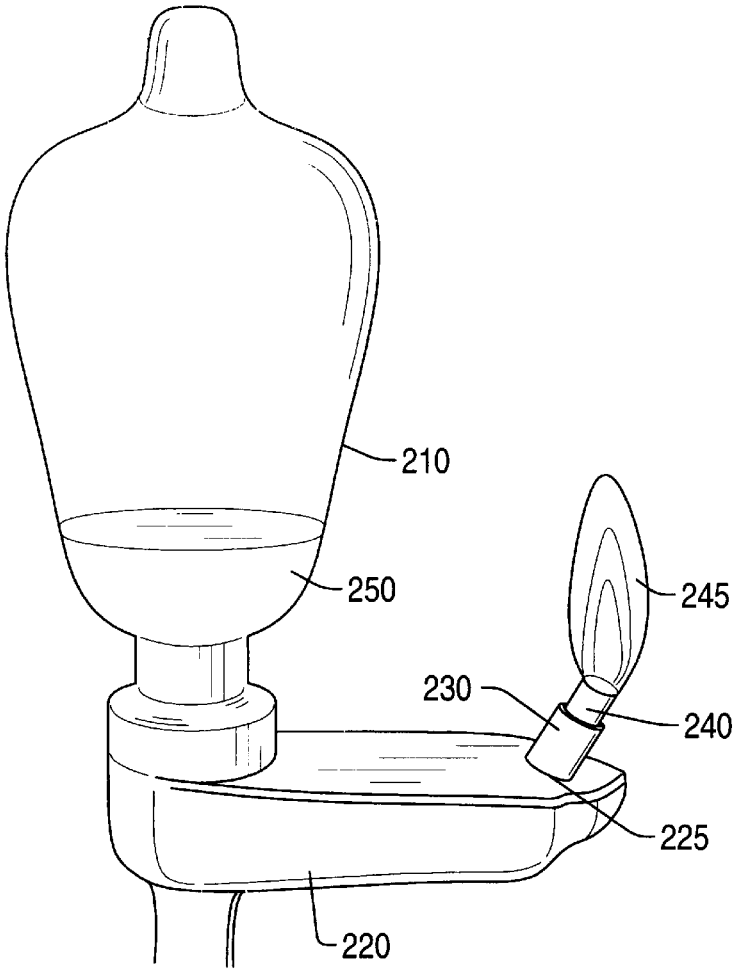
FIG. 2 is an illustration of a colored flame lamp with a vertical drinking water dispenser receptacle design according to one embodiment.

FIG. 2 is an illustration of a colored flame lamp with a vertical drinking water dispenser design according to one embodiment. The vertical drinking water dispenser lamp includes a reservoir 210 for holding fuel composition 250. The fuel composition may be fed by gravity into receptacle 220.

Support tube 230 extends from the receptacle from opening 225. Wick 240 extends from the inside of the receptacle through opening 225 and through support tube 230. Colored flame 245 burns from the tip of wick 240. The wick may be at about a 45 degree angle or less above a tangent to the surface of the fuel composition.

Figure 3:
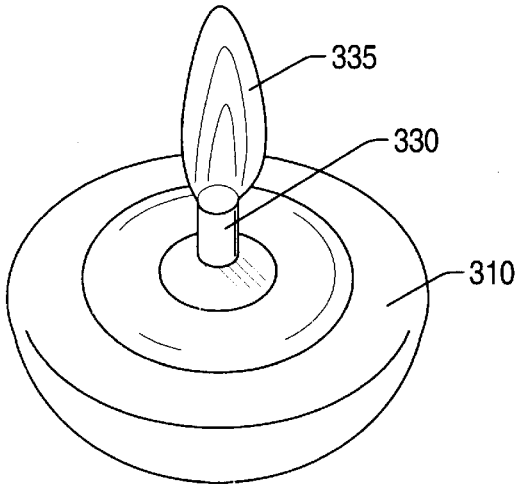
FIG. 3 is an illustration of a colored flame lamp with a modern glass oil lamp with a shallow reservoir design according to one embodiment.

FIG. 3 is an illustration of a colored flame modern glass oil lamp with a shallow reservoir design according to one embodiment. The lamp includes receptacle 310 and wick 330. Colored flame 335 burns from the tip of wick 330. The wick may be at about a 45 degree angle or less above a tangent to the surface of the fuel composition.

In one embodiment, fuel for a colored flame lamp may include a solvent with dissolved metal salts. In general, metal salts may produce characteristic colors when burned. In a colored flame lamp, dissolved metal salts may migrate through a wick and may be deposited on the wick surface. The metal salts may then be heated and vaporized by the flame. The metal vapor absorbs infrared energy in the flame. Characteristic colors are produced as the metal salts release the absorbed energy. The energy is released in the form of visible light of specific wavelengths that correspond to colored light. Generally, the color of light each metal emits is within a narrow bandwidth resulting in a single color appearing to the human eye.

In one embodiment, the solvent may include polyols (i.e., alcohols having two or more hydroxyl groups) such as a glycol. An example of a glycol that may be used is propylene glycol. It may be advantageous to use propylene glycol as a fuel for a colored flame lamp for several reasons. Many metal salts may dissolve in sufficient quantities in propylene glycol to produce a colored flame effect. In addition, propylene glycol burns with an almost colorless flame. Therefore, interference with the characteristic color emitted by a metal may be minimized. In addition, propylene glycol burns such that it provides sufficient energy for the metal salts to absorb heat energy and release it as light energy. Also, propylene glycol produces minimal smoke as it burns. Furthermore, propylene glycol does not spontaneously ignite if spilled while the lamp is burning. Propylene glycol also migrates through the wick easily. Other glycols such as ethylene glycol may also possess similar advantageous properties.

In one embodiment, it may be advantageous to include small amounts of a simple alcohol in a fuel composition composed substantially of a polyol solvent. A simple alcohol may include alkyl alcohols with one hydroxyl group that are liquid at room temperature, such as alcohols having between one and twelve carbons. Examples include, but are not limited to, methanol, ethanol, or isopropanol. For example, inclusion of a simple alcohol may decrease the ignition temperature of a fuel composition composed of a polyol such as propylene glycol. Also, metal salts may dissolve more readily in simple alcohols than in polyols such as propylene glycol. Inclusion of the simple alcohol may prevent recrystallization of the metal salts in the fuel composition. In addition, inclusion of a simple alcohol may decrease the viscosity of a fuel composition of a polyol solvent. A fuel composition with a lower viscosity may migrate up a wick more readily. However, simple alcohols may burn at a lower temperature than propylene glycol. Therefore, the flame produced by simple alcohols may provide less energy for metal salts to absorb and release light energy. Also, a simple alcohol may be more flammable than is desired for a lamp fuel.

In an embodiment, a fuel for a colored flame lamp may be prepared by first dissolving the metal salt in a simple alcohol such as methanol, ethanol, or isopropanol. The mixture may then be combined with a polyol such as propylene glycol. In one embodiment, a volumetric ratio of simple alcohol to propylene glycol may be approximately 0.045 to approximately 0.055. As the volumetric ratio of simple alcohol to propylene glycol is decreased, the fuel composition may become less flammable than is desired. As the volumetric ratio is increased, the fuel composition may become more flammable than is desired.

In another embodiment, a fuel composition may be prepared by first heating the propylene glycol to between about 110° F. to about 130° F. A metal salt and a simple alcohol may then be added to the propylene glycol. The fuel composition may be kept at this temperature for at least about ten minutes after adding the metal salt and simple alcohol. Alternatively, the metal salt and alcohol may be added at any time during the heating of the propylene glycol.

A variety of metal salts may be used. A metal salt should be at least partially soluble in the fuel composition. In addition, the metal should emit a characteristic color when vaporized. For example, salts of one or more metals from Groups Ia, IIa, Ib, and IIIa may be suitable.

In one embodiment, a boron salt such as boric acid may be dissolved in a solvent to produce a green flame. In another embodiment, a lithium salt such as lithium chloride, or lithium hydroxide may be dissolved in the solvent to produce a red flame. A strontium salt such as strontium nitrate may also be dissolved in the solvent to produce an orange-red flame. In one embodiment, it may be advantageous to include strontium nitrate and lithium hydroxide in a solvent. The presence of two or more metal salts may result in a flame with a more saturated and intense red color. In addition, the presence of two or more metal salts may result in a more stable red flame. For example, lithium hydroxide alone may produce an unstable red flame. Furthermore, the presence of the two metal salts may decrease fouling of the wick.

In an embodiment, a copper salt such as copper chloride, copper hydroxide or copper sulfate may be dissolved in a solvent to produce a blue or aqua flame. In an embodiment, a potassium salt such as potassium chloride may be dissolved in a solvent to produce a purple flame.

In an embodiment, a calcium salt such as calcium hydroxide may be dissolved in a solvent to produce a red-orange flame. Alternatively, a sodium salt such as sodium hydroxide may be dissolved in a solvent to produce a yellow-orange flame. In another embodiment, a magnesium salt such as magnesium hydroxide may be dissolved in a solvent to produce a silver-white flame.

In one embodiment, it may be advantageous to include chloride ions in a fuel composition. The presence of chloride ions tends to brighten the flame by suppressing the yellow and white light that appears in the flame. Chloride ions may be supplied by dissolving a metal chloride, such as lithium chloride, in the fuel composition. However, using a metal chloride in the fuel composition may result in excessive fouling of the wick. The concentration of the salt may be decreased to reduce fouling. However, decreasing the salt concentration may result in a fading of the color and decrease in brightness of the flame.

Alternatively, a metal salt, such as lithium hydroxide may be used in the fuel composition. Chloride ions may also be supplied by addition of hydrochloric acid solution to the fuel composition. In one embodiment, hydrochloric acid may be added until the fuel composition is either at a neutral pH or slightly acidic. In other embodiments, hydrochloric acid may be added until the pH is approximately one.

In one embodiment, water in the fuel composition may cause yellow sputtering of the flame. Water may be present because propylene glycol is a desiccant and absorbs water from the air. In one embodiment, water may be removed from the propylene glycol by treating the propylene glycol with a drying agent. Drying agents may include, for example, molecular sieves or magnesium metal.

In one embodiment, the flame may sputter for about 5 minutes after lighting the wick. The lamp may then burn with a relatively consistent flame for at least about 2 hours or until the fuel runs low.

A proper concentration of metal salt in the solvent may be very important to achieve satisfactory operation of the colored flame lamp. As the salt concentration is decreased, the characteristic color of the metal salt may fade. A flame may become less bright, saturated, and homogeneous. As the salt concentration increases, fouling of the wick increases. A salt concentration may be determined by a trial and error procedure. An amount of salt may be added to a solvent and the properties of the flame and the fouling of the wick may be observed. If the properties of the flame or fouling of the wick are not satisfactory, a new composition may be prepared with more or less added salt to enhance brightness or decrease fouling, respectively.

In one embodiment, a fuel composition that produces a green flame may include about 0.014 to about 0.017 grams of boric acid per ml of propylene glycol.

In one embodiment, a fuel composition that produces a red flame may include about 0.0006 grams to about 0.001 grams of lithium hydroxide per ml of propylene glycol. The fuel composition may also include a simple alcohol with a volumetric ratio of simple alcohol to propylene glycol of about 0.045 to about 0.055. The fuel composition may also include hydrochloric acid with a volumetric ratio of 35% hydrochloric acid to propylene glycol of about 0.002 to about 0.005.

Another embodiment of a fuel composition that produces a red flame may include about 0.003 to about 0.005 grams of lithium chloride per ml of propylene glycol. The fuel composition may also include a simple alcohol with a volumetric ratio of simple alcohol to propylene glycol of about 0.045 to about 0.055.

In one embodiment, a fuel composition that produces a blue flame may include about 0.016 to about 0.024 grams of copper hydroxide per ml of propylene glycol. The fuel composition may also include a simple alcohol with a volumetric ratio of simple alcohol to propylene glycol of about 0.045 to about 0.055. The fuel composition may also include hydrochloric acid with a volumetric ratio of 35% hydrochloric acid to propylene glycol of about 0.002 to about 0.005.

In one embodiment, a fuel composition that produces a purple flame may include about 0.012 to about 0.018 grams of potassium hydroxide per ml of propylene glycol. The fuel composition may also include a simple alcohol with a volumetric ratio of simple alcohol to propylene glycol of about 0.045 to about 0.055. The fuel composition may also include hydrochloric acid with a volumetric ratio of 35% hydrochloric acid to propylene glycol of about 0.002 to about 0.005.

In one embodiment, a fuel composition that produces a red-orange flame may include about 0.012 to about 0.018 grams of calcium hydroxide per ml of propylene glycol. The fuel composition may also include a simple alcohol with a volumetric ratio of simple alcohol to propylene glycol of about 0.045 to about 0.055. The fuel composition may also include hydrochloric acid with a volumetric ratio of 35% hydrochloric acid to propylene glycol of about 0.002 to about 0.005.

Figure 4:
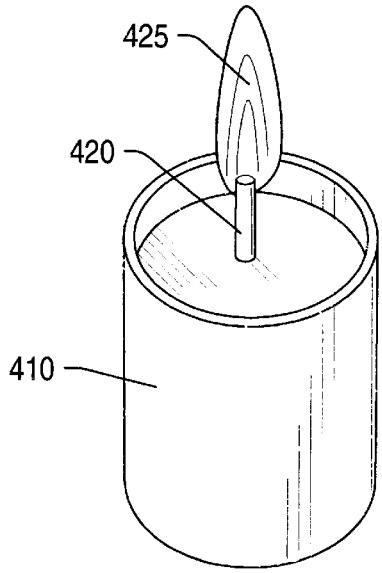
FIG. 4 is an illustration of a colored flame candle according to one embodiment.

FIG. 4 is an illustration of a colored flame candle according to one embodiment. The candle 410 may include a wick 420. Colored flame 425 burns from the tip of wick 420. The candle may be composed substantially of a liquid solvent with dissolved metal salts, and a hardener. The hardener converts the liquid solvent into gel or solid form.

In one embodiment, the solvent may be a polyol such as propylene glycol. The hardener may be a long chain fatty acid, eg., stearic acid. In one embodiment, a metal salt may be dissolved in the solvent to produce a colored flame. The fraction of long chain fatty acid in the candle composition may be increased to make the candle firmer. However, the increased fraction of long chain fatty acids may result in a flame that is more white or yellow and less colorful. A variety of metal salts, such as those described for use in a colored flame lamp, may be dissolved in the fuel composition to produce a colored flame. The concentration of metal salt may be increased to compensate for the loss of color in the flame due to the increase in the fatty acid.

In one embodiment, a candle composition that produces a firm candle may have a volumetric ratio of a long chain carboxylic acid to solvent of between about 0.3 to about 0.5, e.g. stearic acid to propylene glycol ratio of about 0.36 to about 0.4. To produce a green flame, the candle composition may include about 0.1 to about 0.15 grams of boric acid per ml of propylene glycol. In another embodiment, a candle composition that produces a soft candle that burns with little smoke may have a volumetric ratio of carboxylic acid to propylene glycol of about 0.3 to about 0.35. The candle composition may include about 0.03 to about 0.04 grams of boric acid per ml of propylene glycol.

Figure 5:
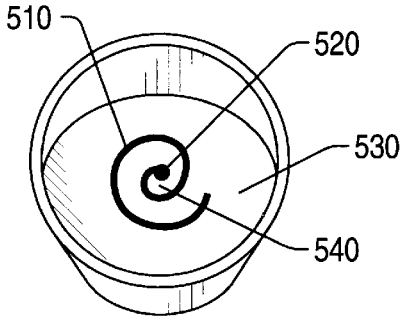
FIG. 5 is an illustration of a candle with a copper coil on its surface according to one embodiment.

Generally, the wick in the colored flame candle may tend not to shorten as fast as a wick in a conventional wax candle. FIG. 5 is an illustration of a candle with a copper coil that keeps the wick at a nearly constant level above the surface of the candle according to one embodiment. A copper coil 510 to which the wick 520 is attached sits on the solid portion 530 of the candle under a liquid layer 540 melted by the heat of the flame. The coil and the wick may sink slowly as the liquid is consumed by burning and the solid fuel melts. The coil may be supported by the solid mass beneath the liquid layer. The coil may keep the wick at a nearly constant level above the surface of the candle. In addition, the coil may result in a stable flame size and color. Generally, the candle may reach thermal equilibrium. The thickness of the liquid layer may remain constant such that the flame retains a stable appearance. If the wick is too long, the candle may burn at a higher temperature resulting in fading of the characteristic color.

Although the system and method of the present invention have been described in connection with several embodiments, the invention is not intended to be limited to the specific forms set forth herein, but on the contrary, it is intended to cover such alternatives, modifications, and equivalents as can be reasonably included within the spirit and scope of the invention as defined by the appended claims.

What is claimed is:

1. A liquid composition for a lamp, comprising:

a liquid solvent composed substantially of propylene glycol;

a metal salt, wherein at least a portion of the metal salt is dissolved in the solvent;

hydrochloric acid;

wherein at least the solvent and the metal salt of the composition are adapted to, during use, migrate through a wick that is in contact with the composition;

wherein the composition, when absorbed by the wick, is adapted to burn with a flame with a color different from the flame of the solvent burning in the absence of the metal salt or from the color of the flame of conventional lamps or candles; and wherein the composition is a liquid at or near room temperature.

2. The composition of claim 1, wherein the solvent is mixed with a small amount of a simple alcohol.

3. The composition of claim 1, wherein the metal salt comprises a Group Ia salt.

4. The composition of claim 1, wherein the metal salt comprises a Group IIa salt.

5. The composition of claim 1, wherein the metal salt comprises a Group Ib salt.

6. The composition of claim 1, wherein the metal salt comprises a Group IIIa salt.

7. The composition of claim 1, wherein the metal salt comprises boric acid.

8. The composition of claim 1, wherein the metal salt comprises lithium hydroxide.

9. The composition of claim the metal salt comprises lithium chloride.

10. The composition of claim 1, wherein the metal salt comprises copper hydroxide.

11. The composition of claim 1, wherein the metal salt comprises potassium hydroxide.

12. The composition of claim 1, wherein the metal salt comprises calcium hydroxide.

13. A method of generating a colored flame, comprising:

placing a composition within a receptacle of an oil lamp, wherein the composition comprises a liquid solvent, hydrochloric acid, and a metal salt, wherein at least a portion of the metal salt is dissolved in the solvent, and wherein the liquid solvent is composed substantially of propylene glycol;

contacting the composition with a wick placed within the receptacle, wherein at least the solvent and the metal salt are adapted to migrate through the wick during use; and igniting the composition that has migrated through the wick.

14. The method of claim 13, wherein the receptacle comprises a Roman clay lamp receptacle design.

15. The method of claim 13, wherein the receptacle comprises a vertical drinking water dispenser lamp design.

16. The method of claim 13, wherein the receptacle comprises a modern glass oil lamp with a shallow reservoir design.

17. The method of claim 13, wherein the wick comprises a natural material.

18. The method of claim 13, wherein the wick comprises a synthetic material.

19. The method of claim 13, wherein the wick is at least partially enclosed in a metallic support tube.

20. The method of claim 13, wherein the solvent is mixed with a small amount of a simple alcohol.

21. The method of claim 13, wherein the metal salt comprises a Group Ia salt.

22. The method of claim 13, wherein the metal salt comprises a Group IIa salt.

23. The method of claim 13, wherein the metal salt comprises a Group Ib salt.

24. The method of claim 13, wherein the metal salt comprises a Group IIIa salt.

25. The method of claim 13, wherein the metal salt comprises boric acid.

26. The method of claim 13, wherein the metal salt comprises lithium hydroxide.

27. The method of claim 13, wherein the metal salt comprises lithium chloride.

28. The method of claim 13, wherein the metal salt comprises copper hydroxide.

29. The method of claim 13, wherein the metal salt comprises potassium hydroxide.

30. The method of claim 13, wherein the metal salt comprises calcium hydroxide.

31. A system for providing a colored flame, comprising:

a receptacle;

a composition disposed within a receptacle of an oil lamp, wherein the composition comprises a liquid solvent, hydrochloric acid, and a metal salt, wherein at least a portion of the metal salt is dissolved in the solvent, and wherein the liquid solvent is composed substantially of propylene glycol;

a wick in contact with the composition; and wherein at least the solvent and the metal salt are adapted to migrate through the wick that is in contact with the composition during use.

32. The system of claim 31, wherein the receptacle comprises a Roman clay lamp receptacle design.

33. The system of claim 31, wherein the receptacle comprises a vertical drinking water dispenser lamp design.

34. The system of claim 31, wherein the receptacle comprises a modern glass oil lamp with a shallow reservoir design.

35. The system of claim 31, wherein the wick comprises a natural material.

36. The system of claim 31, wherein the wick comprises a synthetic material.

37. The system of claim 31, wherein the wick is at least partially enclosed in a metallic support tube.

38. The system of claim 31, wherein the wick is supported by a support tube.

39. The system of claim 31, wherein the solvent is mixed with a small amount of a simple alcohol.

40. The system of claim 31, wherein the metal salt comprises a Group Ia salt.

41. The system of claim 31, wherein the metal salt comprises a Group IIa salt.

42. The system of claim 31, wherein the metal salt comprises a Group Ib salt.

43. The system of claim 31, wherein the metal salt comprises a Group IIIa salt.

44. The system of claim 31, wherein the metal salt comprises boric acid.

45. The system of claim 31, wherein the metal salt comprises lithium hydroxide.

46. The system of claim 31, wherein the metal salt comprises lithium chloride.

47. The system of claim 31, wherein the metal salt comprises copper hydroxide.

48. The system of claim 31, wherein the metal salt comprises potassium hydroxide.

49. The system of claim 31, wherein the metal salt comprises calcium hydroxide.

* * * * *